United States Patent [19]

Werner

[11] Patent Number: 4,560,190

[45] Date of Patent: Dec. 24, 1985

[54] FASTENING ASSEMBLY

[75] Inventor: Ernest A. Werner, Bristol, Conn.

[73] Assignee: J. H. Sessions & Son, Bristol, Conn.

[21] Appl. No.: 469,903

[22] Filed: Feb. 25, 1983

[51] Int. Cl.[4] ..... E05C 5/02

[52] U.S. Cl. ..... 292/111

[58] Field of Search ..... 292/111, 112, 113, DIG. 31, 292/337

[56] References Cited

U.S. PATENT DOCUMENTS

| | | | |
|---|---|---|---|
| 2,751,240 | 6/1956 | Claud-Mantle | 292/113 |
| 2,853,752 | 9/1958 | Schlueter | 292/111 X |
| 2,876,031 | 3/1959 | Claud-Mantle | 292/112 |
| 3,026,133 | 3/1962 | Swanson | 292/113 |
| 3,034,817 | 5/1962 | Willis | 292/113 |
| 3,259,411 | 7/1966 | Griffiths | 292/113 |
| 3,384,402 | 5/1968 | Swanson | 292/113 |

*Primary Examiner*—Richard E. Moore

*Attorney, Agent, or Firm*—Richard H. Berneike

[57] ABSTRACT

A fastening device of the type used to fasten panels together, such as the lid on a trunk, which is essentially recessed in both the locked and unlocked positions thus avoiding any protrusion of the assembly parts. The operating mechanism, which may be of the cam type, is fixed within the recess of the base plate. The slide member which is moved by the operating mechanism is bent upwardly toward the rim of the recess and terminates in a hinge member also within the recess. A catch member is hinged to the slide member and spring loaded so that the spring will rotate the catch member into the recess in the unlocked position.

6 Claims, 4 Drawing Figures

FASTENING ASSEMBLY

BACKGROUND OF THE INVENTION

The present invention relates to a fastening assembly of the type used to fasten panels together.

Fastening devices of the type represented by the present invention may be used to lock or fasten together a variety of structures such as the lids on trunks, packing cases and the like. They may also be used to fasten together any two structures which meet at a butt-like joint. As used herein, the term "panel" is used to describe and include any structure suitable for securing by the fastening device described herein and includes the panels used to make up trunks and packing cases.

One problem that is encountered by present types of fastening devices of this general type is that they protrude out from the sides of the trunk, case or other panel and form an obstruction particularly when they are in the unlocked position. The protrusions can be hazardous at times and can cut or scrape.

SUMMARY OF THE INVENTION

An object of the present invention is to provide a fastening assembly or device which will essentially be recessed in both the locked and unlocked positions. A more particular feature is that the catch member is spring loaded such that it will automatically move to the unlock, recessed position when the device is unlocked. Additional features and objects will be apparent from the detailed description which follows.

DESCRIPTION OF THE PREFERRED EMBODIMENT

Figure 1:
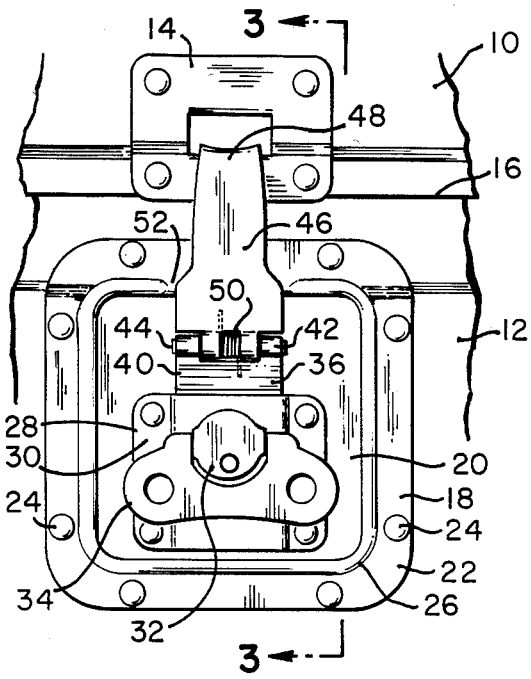
FIG. 1 is a face view of the fastening device of the present invention in the locked position.

FIG. 1 shows two panels 10 and 12 which may, for example, be the lid and body of a trunk or packing case respectively. The panel or lid 10 has a strike 14 attached thereto adjacent the joint 16 between the two panels. The term "strike" is the term commonly used for the hook-engaging member of this general type of fastener.

Attached to the panel or trunk body 12 is the fastening assembly of the present invention. It comprises a base plate 18 with a recessed portion 20 and a rim 22. The recessed portion 20 fits into a recess in the panel 12 while the rim 22 lies on the surface of the panel 12 and is rivetted or otherwise attached to the panel at 24. A portion of the rim 22 is raised above the general surface of the rim to form a ridge 26 extending partially around the rim. (The terms "up" and "down" are used herein to mean down into the recess and up out of the recess rather than up and down in a vertical direction.) The ridge forms a protective edge with the operating portions of the mechanism lying below or substantially below the upper edge of the ridge when in either the locked or unlocked position.

Attached to the base plate 18 within the recessed portion 20 is an operating mechanism 28 which comprises a casing 30, an eccentric mechanism 32 and an operating key 34. Turning the key 34 turns the eccentric mechanism 32 which causes the slide member 36 to move parallel to the base plate 18 in a direction toward and away from the joint 16, i.e., perpendicular to the joint. The slide member 36 is retained within the casing 30. The eccentric mechanism 32 does not form a part of the present invention but reference may be made to U.S. Pat. Nos. 2,853,751 and 2,853,752. In fact, the operating mechanism need not be an eccentric mechanism but may be any device which will produce the longitudinal movement of slide member 36.

The slide member 36 comprises a first portion 38 which partially extends into the casing 30 and is engaged by the eccentric 32 and a second portion 40. This second portion 40 is bent at an angle from the first portion 38 upwardly at an angle toward the rim 22 of the base plate 18 and toward the joint 16. This second portion 40 terminates in a hinge means 42 which is still below the top or upper surface of the ridge 26 of the rim 22 as clearly shown in FIGS. 3 and 4.

Figure 2:
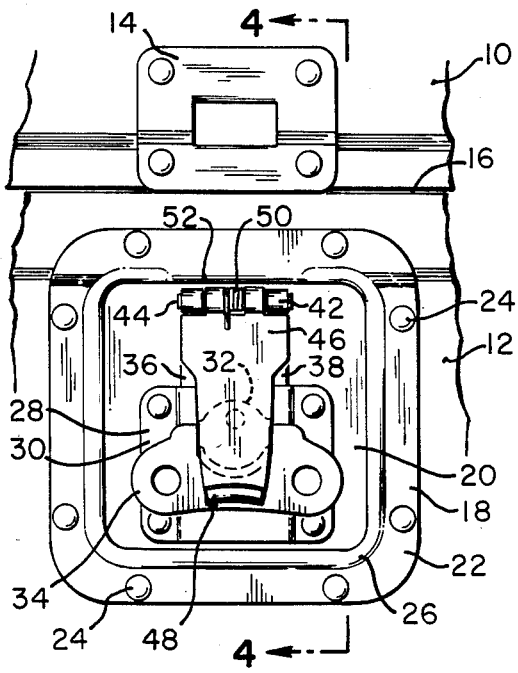
FIG. 2 is a face view in the unlocked position.
Figure 4:
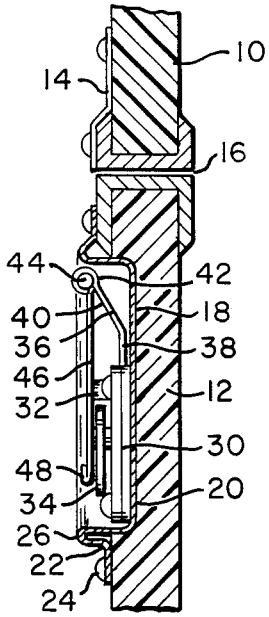

Hinged to the hinge means 42 by means of the hinge pin 44, is a catch member 46 which extends over the rim 22 and over the joint 16 to the strike 14. The hook 48 on the catch member 46 is thus in a position to lockingly engage the strike. Surrounding the hinge pin 44 is a spring 50 which engages the second portion 40 of the slide member 36 and the catch member 46 so as to force the catch member 46 to rotate into an unlocked, retracted position within the recess as shown in FIGS. 2 and 4. When the catch member 46 is unlocked from the strike 14, the spring 50 will automatically rotate the catch member into this retracted position.

Figure 3:
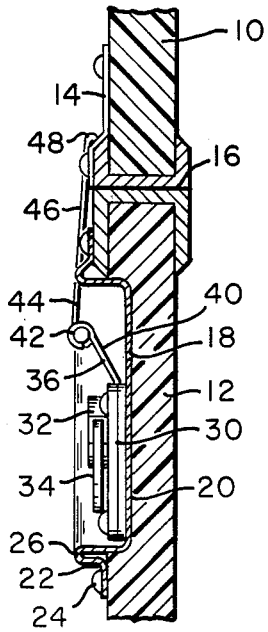
FIGS. 3 and 4 are cross-section views along lines 3—3 and 4—4 of FIGS. 1 and 2 respectively.

As most clearly seen in FIGS. 1 and 3, the ridge 26 has a gap 52 through which the catch member 46 extends when in the locked position. For this reason, the catch member 46 lies below the top of the ridge 26 even when in the locked position. When locking the fastener, the second end portion 40 of the slide member 36 functions as a spring since it is bent at an angle with respect to the direction of force thus assuring a tight, secure lock and providing take-up in gasketing or irregularities in any seal in the joint. This spring action comes about by the deflection of this end portion 40.

Therefore, when trunks or cases or other items are adjacent each other, the ridge will prevent the parts of the fastening means from interfering with each other and possibly becoming unlocked. As seen in FIG. 4, the parts of the fastener including the catch member 46 are contained within the recess 20 and below or substantially below the top of the ridge part of the rim.

I claim:

1. In a fastening assembly for use in securing together first and second panels meeting at a joint wherein said first panel is provided with a strike fixedly attached thereto adjacent said joint and said second panel is provided with a catch unit fixedly attached thereto adjacent said joint; the improvement comprising an improved catch unit comprising:

(a) a base plate including a recessed portion recessed into said second panel and a rim surrounding said recessed portion mounted on the surface of said second panel, (b) a slide member mounted within said recessed portion for sliding movement parallel to said base plate in a direction perpendicular to said joint, said slide member including a first end portion remote from said joint being substantially adjacent the surface of said recessed portion and a second end portion adjacent said joint bent at an angle from said first end portion and extending upwardly from said recessed portion toward said rim and terminating below said rim in a hinge means and said bent second end portion being of such dimension and flexibility as to function as a spring which deflects during locking and unlocking, (c) an operating mechanism fixed on said base plate within said recess portion below said rim operatively connected to said slide member to provide said sliding movement, (d) a catch member having one end hinged to said hinge means on said slide member, said catch member adapted to extend across said rim and said joint and engage said strike in the locked position and including spring means engaging said catch member and said slide member whereby said spring means rotates said catch member on said hinge means into said recessed portion substantially below said rim in the unlocked position.

2. The invention as recited in claim 1 wherein said rim includes a substantially flat portion mounted flush on the surface of said second panel and a ridge portion raised above said flat portion, said ridge thereby defining the upper edge of said recess.

3. The invention as recited in claim 2 wherein said ridge extends around at least a portion of said rim except at the location where said catch member extends across said rim whereby said catch member extends across said rim substantially below the upper edge of said ridge.

4. A catch unit for use in securing together panels meeting at a joint wherein one panel is provided with a strike fixedly attached thereto adjacent said joint and a second panel is provided with a catch unit fixedly attached thereto adjacent said joint, said catch unit comprising:

(a) a base plate including a recessed portion and a rim surrounding said recessed portion, (b) a slide member mounted within said recessed portion for sliding movement parallel to said base plate, said slide member including a first end portion being substantially adjacent the surface of said recessed portion and a second end portion bent at an angle from said first end portion and extending upwardly from said recessed portion toward said rim and terminating below said rim in a hinge means and said bent second end portion being of such dimension and flexibility as to function as a spring which deflects during locking and unlocking, (c) an operating mechanism fixed on said base plate within said recessed portion below said rim operatively connected to said slide member to provide said sliding movement, (d) a catch member having one end hinged to said hinge means on said slide member, and including spring means engaging said catch member and said slide member whereby said spring means rotates said catch member on said hinge means into said recessed portion substantially below said rim in the unlocked position.

5. The invention as recited in claim 4 wherein said rim includes a substantially flat portion and a ridge portion raised above said flat portion, said ridge thereby defining the upper edge of said recess.

6. The invention as recited in claim 5 wherein said ridge extends around at least a portion of said rim except at the location where said catch member extends across said rim whereby said catch member extends across said rim substantially below the upper edge of said ridge.

* * * * *